US009896897B2

(12) United States Patent
Brown et al.

(10) Patent No.: US 9,896,897 B2
(45) Date of Patent: Feb. 20, 2018

(54) SUBSEA UNIVERSAL XMAS TREE HANG-OFF ADAPTER

(71) Applicant: Aker Solutions AS, Lysaker (NO)

(72) Inventors: David Brown, Oslo (NO); Lars Bay, Hosle (NO); Tommy Tårneby, Røyse (NO); Kim W. Christensen, Hyggen (NO); Roar Eide, Oslo (NO); Thor Ketil Hallan, Drammen (NO)

(73) Assignee: Aker Solutions AS, Lysaker (NO)

( * ) Notice: Subject to any disclaimer, the term of this patent is extended or adjusted under 35 U.S.C. 154(b) by 0 days.

(21) Appl. No.: 15/304,921

(22) PCT Filed: May 13, 2015

(86) PCT No.: PCT/EP2015/060629

§ 371 (c)(1),
(2) Date: Oct. 18, 2016

(87) PCT Pub. No.: WO2015/173319

PCT Pub. Date: Nov. 19, 2015

(65) Prior Publication Data

US 2017/0183935 A1 Jun. 29, 2017

(30) Foreign Application Priority Data

May 14, 2014 (NO) ..... 20140609
Sep. 15, 2014 (NO) ..... 20141108

(51) Int. Cl.
*E21B 33/038* (2006.01)
*E21B 33/043* (2006.01)
(Continued)

(52) U.S. Cl.
CPC ..... *E21B 33/0385* (2013.01); *E21B 33/0422* (2013.01); *E21B 43/128* (2013.01)

(58) Field of Classification Search
CPC ..... E21B 33/038; E21B 33/0385; E21B 33/0422; E21B 33/043
See application file for complete search history.

(56) References Cited

U.S. PATENT DOCUMENTS 6,776,230 B2 * 8/2004 Collie ..... E21B 43/128 166/337
7,201,229 B2 * 4/2007 White ..... E21B 43/01 166/344
(Continued)

FOREIGN PATENT DOCUMENTS

CA 2822242 A1 6/2012
GB 2498068 A 7/2013
(Continued)

OTHER PUBLICATIONS

Schneiderbauer, K., "International Search Report," prepared for PCT/EP2015/060629, as dated Jul. 30, 2015, four pages.
(Continued)

*Primary Examiner* — Matthew R Buck
(74) *Attorney, Agent, or Firm* — Winstead PC

(57) ABSTRACT

Adapter (15) for an oil or gas field Christmas tree (4), said adapter (15) comprising a first interface (16) to connect the adapter (15) to a corresponding Christmas tree interface (17) on the top of the Christmas tree (4), distinctive in that the adapter (15) further comprises a second interface (18), at least one feed-through, and at least one of: a well barrier element, an internal profile for setting a plug, a hanger or a combined hanger and plug.

20 Claims, 10 Drawing Sheets

(51) Int. Cl.
*E21B 33/04* (2006.01)
*E21B 43/12* (2006.01)

(56) References Cited

U.S. PATENT DOCUMENTS

| | | | | |
|---|---|---|---|---|
| 7,909,103 | B2 * | 3/2011 | Fenton | E21B 33/035 166/347 |
| 9,428,981 | B2 * | 8/2016 | Hosie | E21B 33/038 |
| 9,593,561 | B2 * | 3/2017 | Xiao | E21B 43/12 |
| 2002/0070030 | A1 | 6/2002 | Smith et al. | |
| 2006/0108118 | A1 | 5/2006 | Bartlett | |
| 2007/0144743 | A1 * | 6/2007 | White | C07D 263/48 166/368 |
| 2007/0289747 | A1 * | 12/2007 | Shaw | E21B 43/128 166/368 |
| 2008/0006412 | A1 | 1/2008 | Ford | |
| 2010/0096144 | A1 | 4/2010 | Mack | |
| 2010/0116506 | A1 | 5/2010 | Sbordone et al. | |
| 2010/0206577 | A1 | 8/2010 | Martinez | |
| 2011/0011596 | A1 | 1/2011 | Martinez et al. | |
| 2011/0300008 | A1 * | 12/2011 | Fielder | E21B 19/002 417/410.3 |
| 2012/0222856 | A1 | 9/2012 | Head | |
| 2014/0048277 | A1 * | 2/2014 | June | E21B 33/035 166/348 |
| 2014/0158347 | A1 | 6/2014 | Fielder et al. | |

FOREIGN PATENT DOCUMENTS

| | | | | |
|---|---|---|---|---|
| WO | WO-2012045771 | A2 * | 4/2012 | E21B 33/072 |
| WO | WO-2012074607 | A1 | 6/2012 | |
| WO | WO-2012148288 | A1 * | 11/2012 | E21B 33/076 |
| WO | WO-2014107470 | A2 | 7/2014 | |

OTHER PUBLICATIONS

American Petroleum Institute, "Recommended Practice for Electrical Submersible Pump Installations," API Recommended Prace 11S3, Second Edition, Mar. 1999, 23 pages.

* cited by examiner

Figure 4 – horizontal feed-through
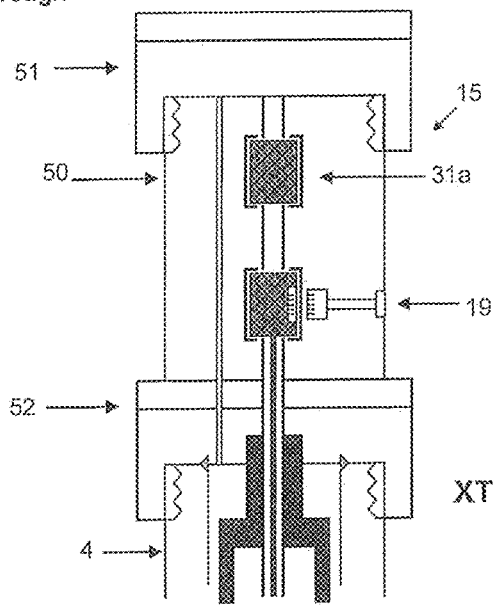
Figure 5 – vertical feed-through
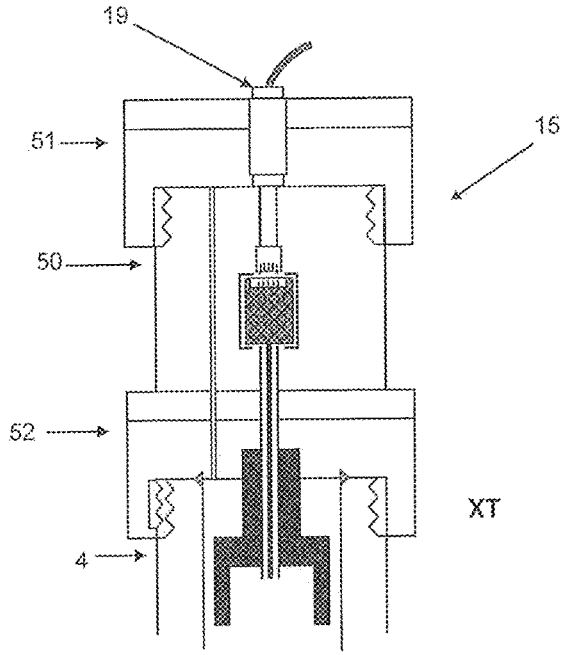

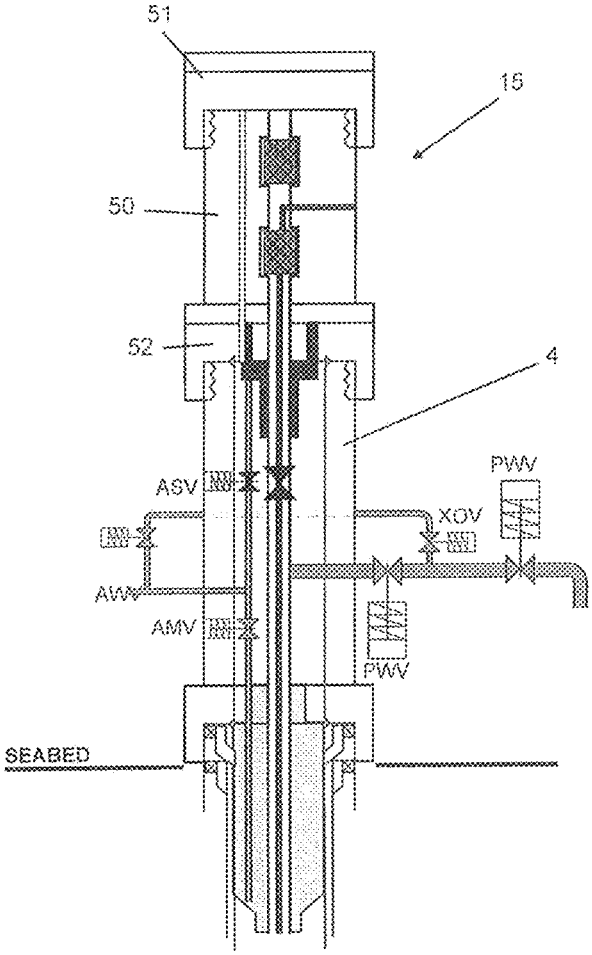
Figure 6 – Hybrid Xmas tree

SUBSEA UNIVERSAL XMAS TREE HANG-OFF ADAPTER

FIELD OF THE INVENTION

In a first aspect, the present invention relates to an adapter for an oil or gas field Christmas tree, as defined in the preamble of the subsequent claim 1.

In a second aspect, the present invention relates to a method for installation of Electric Submersible Pumps (ESPs) or other downhole equipment in subsea wells using an adaptor according to the first aspect of the invention. More specifically, the invention provides a method and equipment for subsea installation of ESPs and other equipment through subsea Xmas trees of in principle any kind and any vendor, without retrieving the existing completion or installing additional hangers inside the Xmas tree spool.

BACKGROUND OF THE INVENTION

Prior Art

Subsea downhole equipment includes boosting equipment like ESPs, in addition to zone control valves, MPFMs (Multiphase Flowmeters), other instrumentation, sleeves, chokes and other equipment. Installing or replacing such equipment is difficult and expensive.

This can be explained with Electrical Submersible Pumps, ESPs, as an example. ESPs are used for artificial lift of fluid from a well. Most wells will benefit from artificial lifting to enhance production. ESPs are one of several options for artificial lifting, useful alone or in combination. Artificial lifting reduces the producing bottom hole pressure on the formation to obtain a higher rate of production from the well. An ESP is typically a centrifugal pump placed downhole. The downhole size restrictions limit the flow rate and pressure head from such pumps. Restricted access and numerous Xmas tree designs limits the practical use and installation. The well integrity, such as the state of sealing surfaces and well barriers, must be maintained. ESPs are typically used for moderate to high volume flow rate wells, and are typically hung from the wellhead in some way. API RP11 S3 describes recommended practice for installation of ESPs.

Typically, there are two methods of installation of ESPs, namely:

1. Pulling the production tubing and reinstalling it with the ESP,

2. Installing the ESP through existing production tubing. This method severely restricts size and type of the ESP, but allows lower installation and work-over costs.

The present invention relates to method 2, but it is not limited to ESPs alone, but for any of the equipment mentioned above. There are ongoing works performed to install a hanger system inside the subsea x-mas tree (XT) design for such through-tubing installed equipment, but all these designs require the hang-off point to be specific to the actual type of XT.

Some patent publications describing background art or related art are US 2011/0011596 A, US 20100096144 A1, US 2002070030 A1, WO 2014107470 A2, US 2014158347 A1, CA 2822242 A1, US 2012222856 A1 and WO 2012074607 A1.

GB 2498068 A shows a drilling riser adapter that provides ports for umbilicals or flexible hoses. However, this adapter does not provide any interface for receiving a barrier element or similar plug element.

A first objective of the present invention is to provide an adapter for a Christmas tree that enables setting of a well barrier element, an internal profile for setting a plug, a hanger or a combined hanger and plug. Another objective of the invention is to provide a method facilitating installation of an ESP and other equipment in a subsea well, through the existing production tubing.

SUMMARY OF THE INVENTION

The invention meets the objective by providing an adapter for an oil or gas field Christmas tree, said adapter comprising a first interface to connect the adapter to a corresponding Christmas tree interface on the top of the Christmas tree, distinctive in that the adapter further comprises a second interface, at least one feed-through, and at least one off: a well barrier element, an internal profile for setting a plug, a hanger or a combined hanger and plug.

Preferably, the second interface is in an end of the adapter opposite of said first interface, the at least one feed through, arranged lateral or axial, connects the inside of the adapter to the outside of the adapter, and at least one well barrier is a well barrier compliant valve or plug, or a combination thereof.

Preferably, the feed-through is configured to convey one or more of: electric power, electric communication, optical communication, hydraulic liquid, and gas, in any combination.

The adapter preferably comprises a string hanging down into a production tubing from a lower well barrier, said string comprising all or some of the lines, cables and tubes of the feed-through. Preferably, said string is a coiled tubing enclosing said lines, cables and tubes, said coiled tubing being suspended from a plug within said Christmas tree or said adapter.

Preferably, said feed-through is extending laterally through a sidewall of said adapter. Alternatively, said feed-through is extending vertically through a cap on top of said adapter. Preferably, said feed-through is arranged below said at least one well barrier. However, preferably the adapter comprises two well barriers and said feed-through is arranged between said two well barriers.

The adapter preferably comprises a Xmas tree connector either adapted to interface with a tubing hanger of the Xmas tree, for connecting to horizontal Xmas trees, or with the inside of the Xmas tree spool, for connecting to vertical Xmas trees.

The adapter is capable of withstanding well pressure, preferably also the pressure of high pressure wells.

Preferably, the second interface is an H4 profile.

The invention also provides a method for installation of an ESP or other subsea downhole equipment fitting into the existing completion of a subsea well. The method is distinctive by the steps:

to close isolation valves on either side, relative to the production flow, of the subsea Xmas tree crown plugs, optionally, to circulate out hydrocarbon fluid from the isolated volume between said closed isolation valves and balance out pressure, to remove the crown plugs on top of the subsea Xmas tree, to install the ESP or other subsea downhole equipment, as hanging from a string from a lower well barrier of an adaptor according to the invention, by deploying the equipment and adaptor in position and connecting the adaptor to the Xmas tree, permanently installing the adaptor on top of the subsea Xmas tree.

Preferably, the adaptor, with subsea downhole equipment connected, are mounted in a frame and installed using the existing Xmas tree guiding system.

It is also possible to install the adaptor and the ESP by using an open water workover system.

The present invention may in its most elaborate aspect comprise four main parts:

1. A Christmas tree adapter with a feed-through of a power and signal cable, as described above, including a related method.

2. A power and signal cable suspended from the Christmas tree adapter.

3. A docking station for the pump unit.

4. A per se conventional pump unit.

The present invention is suitable for co-operation with an arrangement for docking an electrical submersible pump in an oil or gas well, comprising a docking station with a landing profile to receive a pump unit and a power and signal cable connected to said docking station, distinctive in that it further comprises sealing and setting elements for engaging the docking station with the inner surface of a production tubing and a cable weak link on said cable or between said cable and said docking station.

The docking station preferably comprises at least one plug landing and setting profile. Said sealing and setting elements preferably are of a type that is capable of securing the docking station to a slick inner surface of said production tubing.

In a further aspect the present invention can co-operate with an electrical submersible pump arrangement for an oil or gas well, comprising a docking station with a landing profile to receive a pump unit and a power and signal cable connected to said docking station, said docking station being arranged within a production tubing, distinctive in that said cable is connected to said docking station within said production tubing and extends within said production tubing between said docking station and a Christmas tree. Said cable preferably extends through an adapter attached to the top of said Christmas tree. Preferably, said cable extends through a feed-though at the side of said adapter. Preferably, said cable is enclosed within a coiled tubing, said coiled tubing being suspended from a plug within the Christmas tree or said adapter.

In a first aspect, the invention pertains to an adapter for an oil or gas field Christmas tree, said adapter comprising a first interface to connect the adapter to a corresponding Christmas tree interface on the top of the Christmas tree.

The adapter has a second interface opposite of said first interface, said second interface can be identical to or different from the Christmas tree interface.

This provides the possibility of equipping the Christmas three with additional features, such as additional plug profiles, cable feed through, additional valves and sensors.

Preferably, the adapter is a high-pressure unit capable of withstanding well pressure. Consequently, only one plug will be necessary and a debris cap can be used on top of the adapter.

Preferably, the second interface is an H4 profile. Thereby, standard equipment for connection to a Christmas tree with an H4 profile can be used to connect to the top of the adapter.

The present invention overcomes the limitations related to prior art solutions by establishing a universal interface that allows for installation of and connection (hydraulic, optical, electrical, gas injection) to through-tubing installed equipment for wells with all types of subsea XTs (horizontal, vertical, hybrid). The adaptor of the invention preferably provides a hanger element useful for installation and subsequent work-over, without retrieving the existing completion or installing additional hangers inside the Xmas tree spool, which provides significant simplifications and cost savings over the life of the subsea well.

The adaptor of the invention preferably has the hanger and well barriers on an extension hub mounted above the existing XT body while still maintaining the barrier requirements of subsea systems. It also makes it possible to install equipment later in the production phase while the existing equipment is kept in place. The weight and forces imposed by the new equipment can be distributed between the adaptor and the completion to avoid unnecessary loads on to the wellhead by using deep-set packers.

Preferably, one or both of the well barriers comprise feed-throughs for one or more of: electric power, electric communication, optical communication, hydraulic liquid, and gas, in any combination. Preferably, one or both of the well barriers are well barrier compliant valves or plugs, or a combination thereof. The adaptor according to the invention preferably comprises a string hanging down into the production tubing from the lower well barrier; the string may or may not comprise all lines, cables and tubes of the feed-through, preferably imbedded in a tube or pipe, in feed-throughs and string or both. Preferably, wet mate-able connectors are included in the feed-throughs, string or both.

Preferably, the adaptor comprises a feedthrough that is brought horizontally or laterally from the lower well barrier or from between the lower and upper well barrier, out of a sidewall of the extension hub, the extending part of the adaptor.

The adaptor preferably comprises a plug as the upper well barrier, for the embodiment with lateral or horizontal feedthroughs or penetrators. Alternatively, feed-throughs are taken out of the adaptor through the top, for which embodiment feed-throughs or penetrators preferably are arranged through both of the well barriers.

The adaptor preferably comprises an Xmas tree connector either adapted to interface with a tubing hanger of the Xmas tree, for connecting to horizontal Xmas trees, or with the inside of the Xmas tree spool, for connecting to vertical Xmas trees. Other connector design can also be feasible.

Preferably, the upper connector part is a connector part interfacing BOPs (blow out preventers), LRPs (lower riser packages), other intervention equipment and an upper high pressure debris cap, such as an H-4 profile or subsea connector.

Preferably, the adaptor, with subsea downhole equipment connected, is mounted in a frame and installed using the existing Xmas tree guiding system.

The adaptor of the invention, also termed a SUTHA (subsea universal tree hang-off adaptor) can be installed on top of all types of Xmas trees, also termed XTs, and can be utilized for both green field and brown field developments. Two well barriers, the lower one of which is an additional hanger, are included in the SUTHA that can replace the conventional crown plugs in top of the XT. The invention also covers the use of barrier compliant valves instead of plugs if needed. The well barriers or plugs will act as barrier elements during normal production mode of the well in the same manner as conventional crown plugs do in the XT. At least one of the plugs is preferably designed with electric, hydraulic and gas feed-through in addition to communication lines. A string will be installed below the SUTHA to transfer the power (hydraulic and electric) and communications (electrical, optical fiber) downhole. The string can also be used for gas injection where gas can be pumped upstream through the string and released at various depths in the well depending on the specific needs for gas-lift or other purposes. Such string can also be used for conveying pressurized fluid for driving a downhole hydraulic pump or other purposes. Such string can be coiled tubing with power and signal lines inside, a wireline or fiber rope with imbedded service lines or other types of intervention strings. Any necessary new equipment can be installed as long as it can be fitted into the existing completion size. The main equipment in the SUTHA (plugs, connection interfaces and specific XT interface profile) will be mounted in a frame that can be installed in the existing XT guiding system.

Coiled tubing, an installation umbilical, or connections to an existing umbilical, are preferably used during installation.

The adaptor is designed to be permanently installed on an existing XT, enabling the possibility to install and communicate to new downhole equipment without retrieving the completion of a well.

The SUTHA will be designed to interface on top of all types of XTs independent of vendor. Typically, this will be done by including the actual vendor's XT interface connector on the lower side. On top of the SUTHA a suitable profile will be included (for example the H-4 profile) to interface towards BOP, LRP or other intervention equipment.

FIGURES

FIG. 4 illustrates horizontal feed-through in an adaptor of the invention, FIG. 5 illustrates vertical feed-through in an adaptor of the invention, and FIG. 6 illustrates an adaptor of the invention installed on a hybrid Xmas tree.

Figure 7:
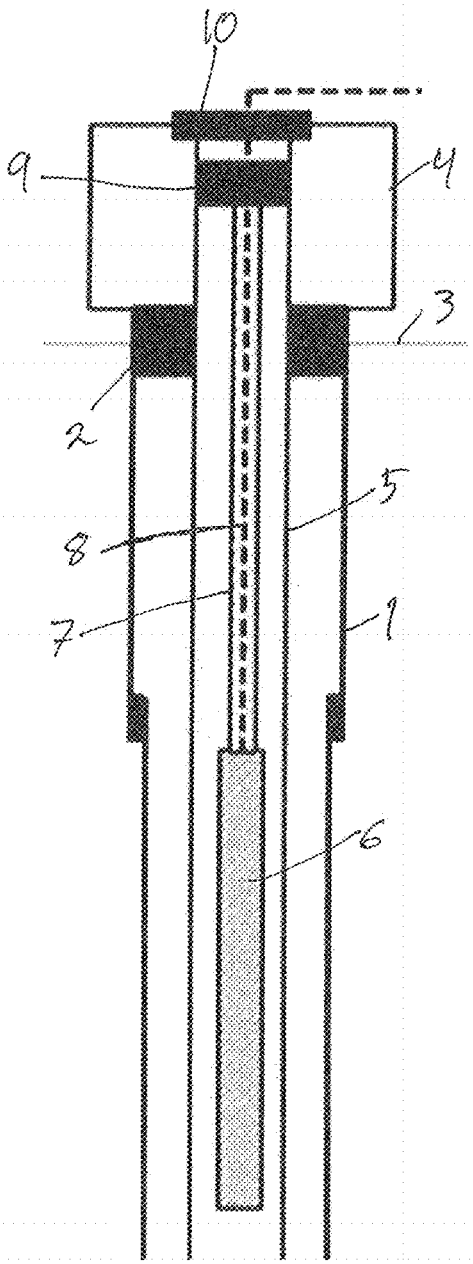
Fig. 7 (Prior art)
Figure 8:
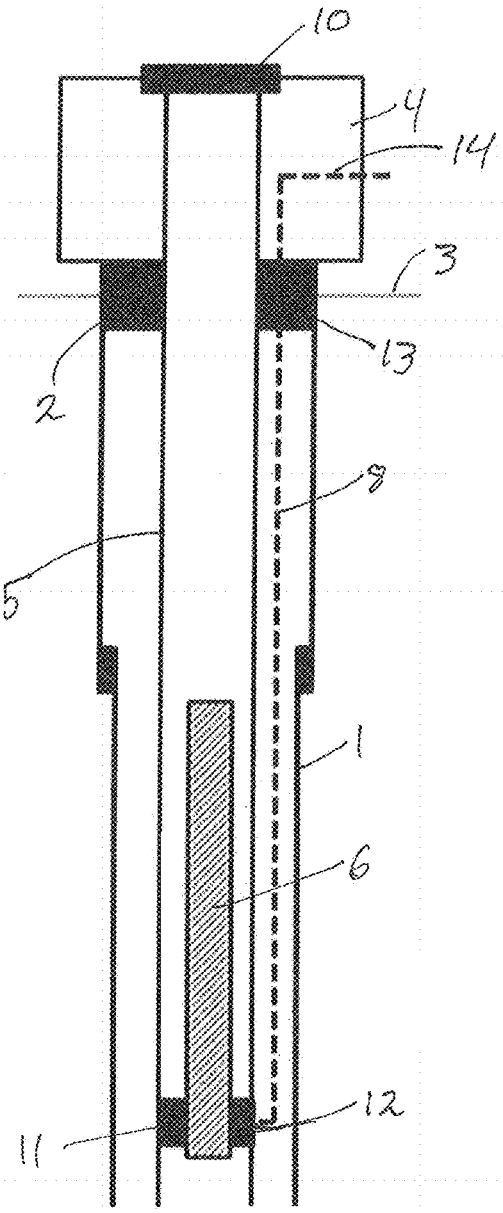
Fig. 8 (Prior art)
Figure 9:
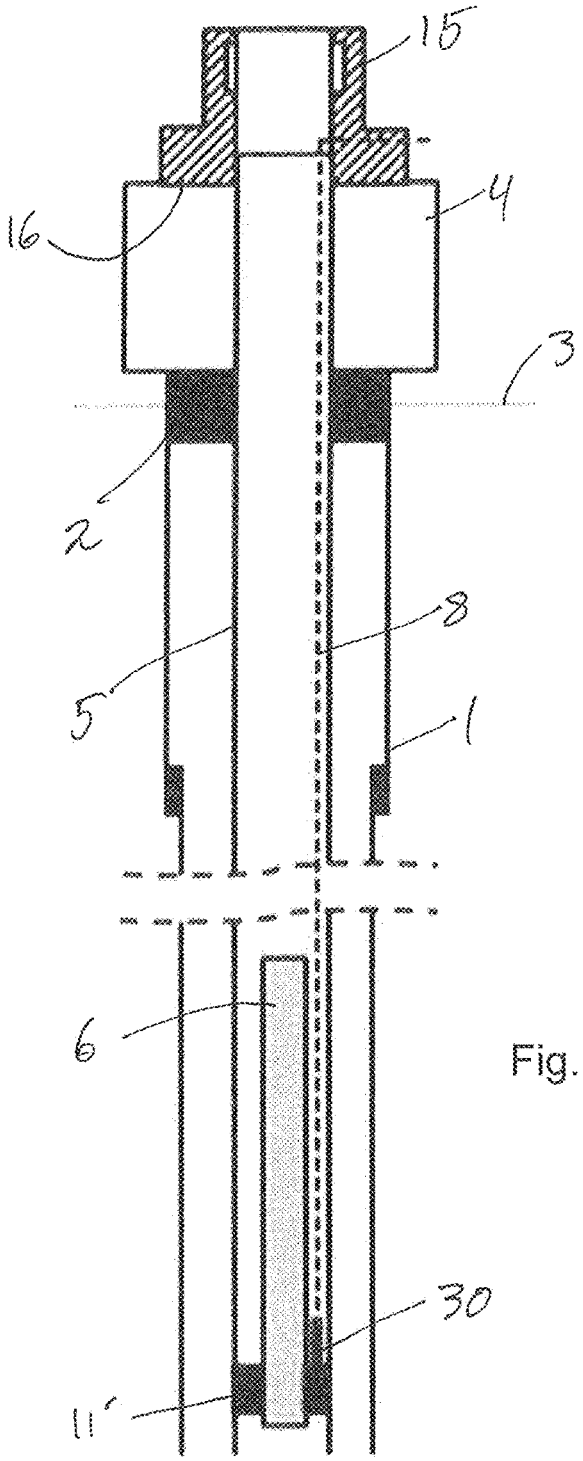
Figure 10:
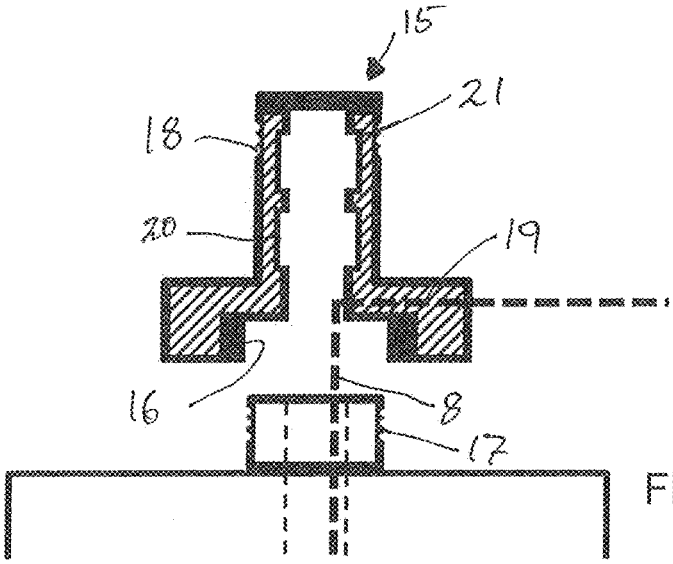
Figure 11:
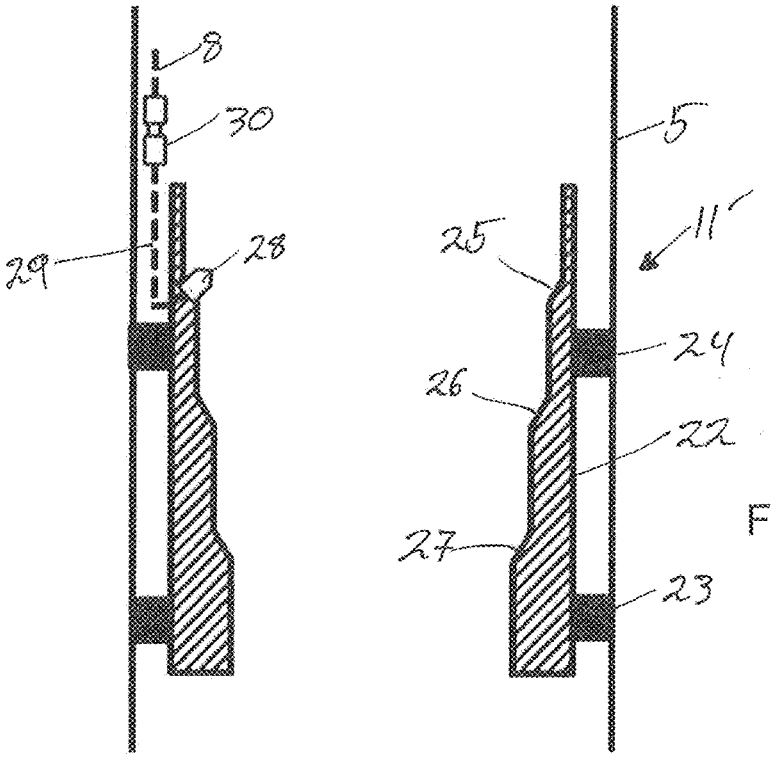
Figure 12:
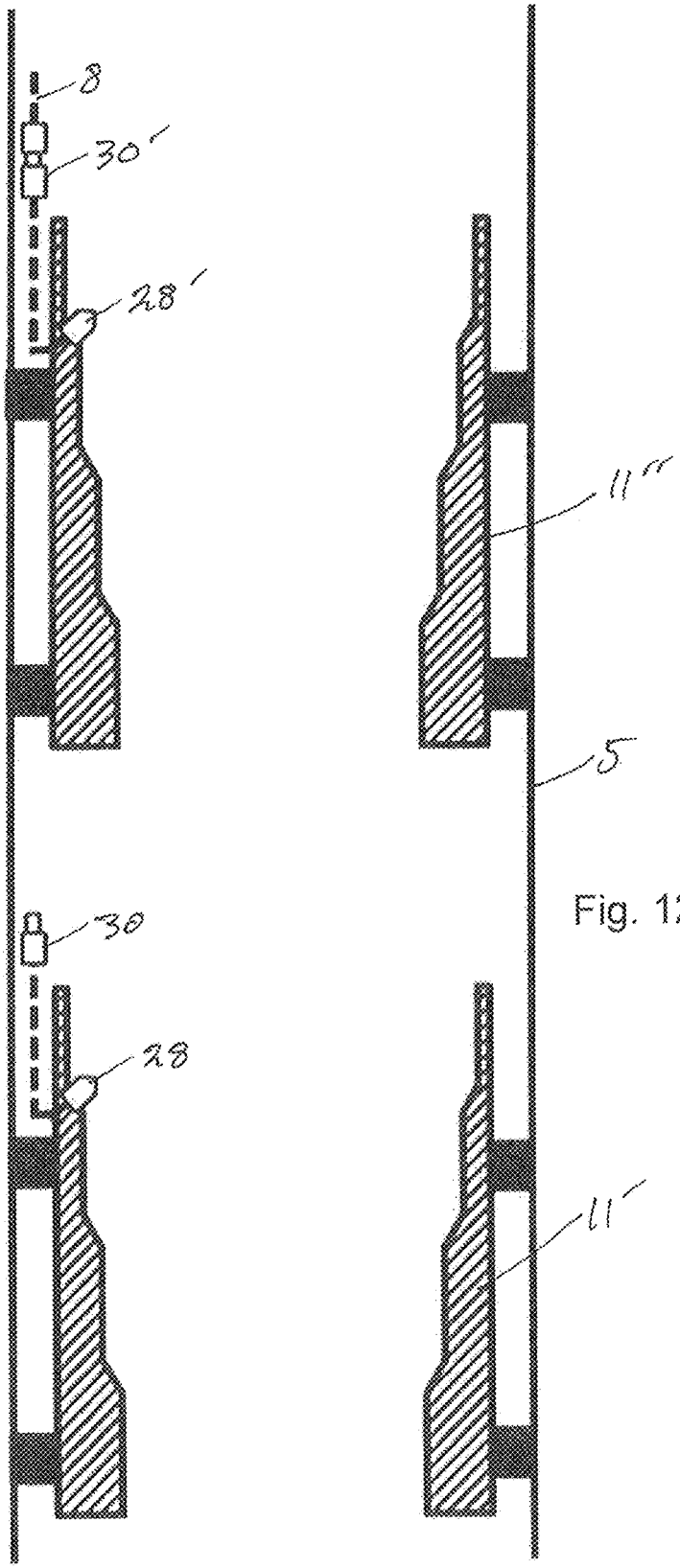
Figure 13:
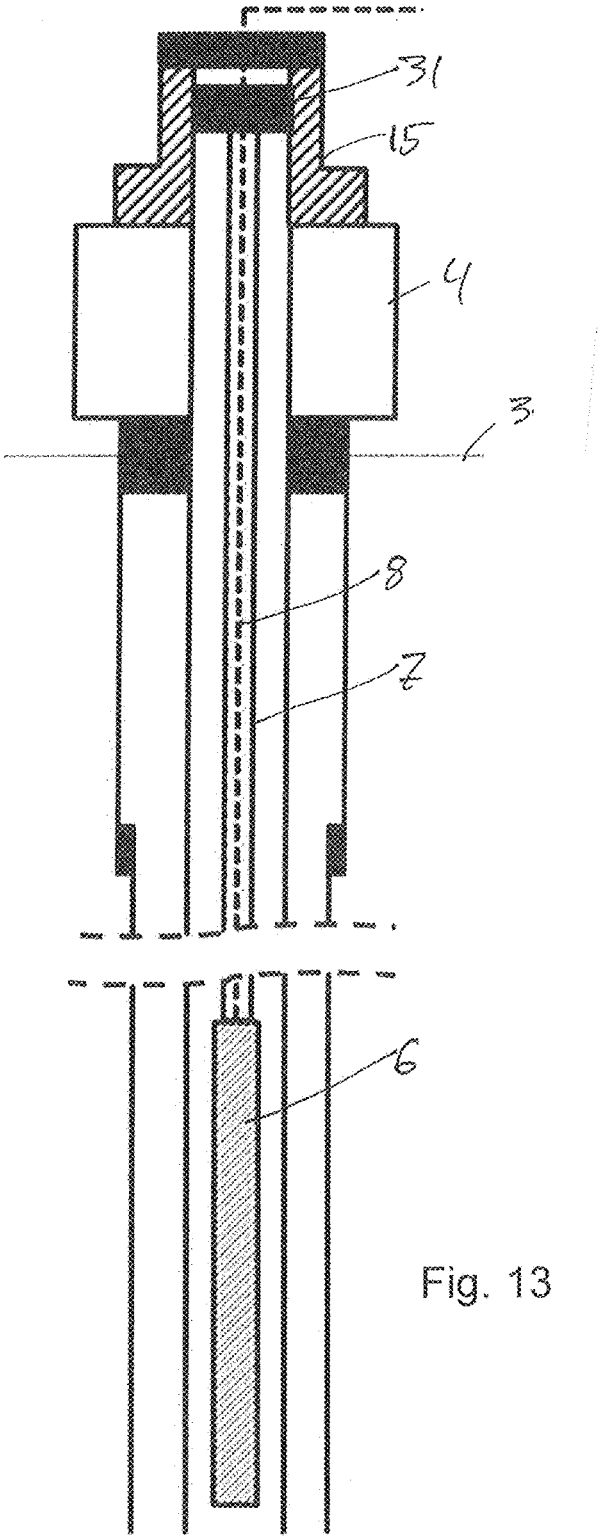

FIGS. 7 and 8 illustrate prior art embodiments related to installation of ESPs, FIG. 9 shows a principle arrangement according to the invention, FIG. 10 shows an adapter according to the invention, FIG. 11 shows a docking station that can be used together with the invention, FIG. 12 shows the situation in the well when a docking station has been replaced by a new docking station, and FIG. 13 shows an alternative embodiment of an arrangement incorporating the adaptor of the present invention.

DETAILED DESCRIPTION

In the following, the same reference number has been used for items that have the same function, even though the item may not be identical throughout the various embodiments.

Figure 1:
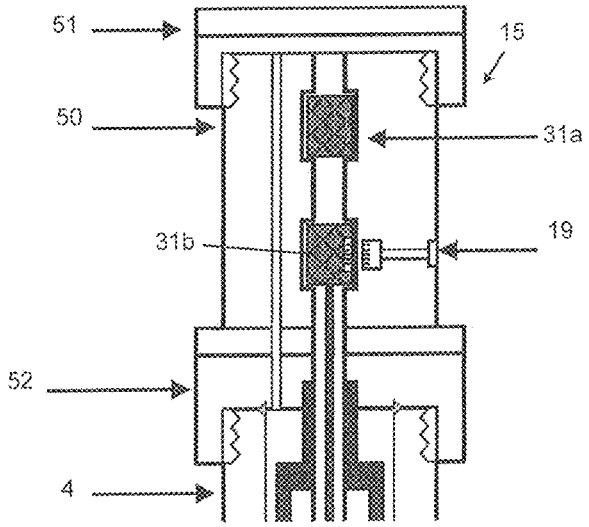
FIG. 1 is an overview of an adaptor of the invention.

FIG. 1 illustrates an example of a SUTHA, i.e. an adaptor 15, of the invention. Two plugs 31*a* and 31*b* in the design replace the two crown plugs in the XT 4 to maintain sufficient well integrity during production. The plugs have been set in a respective plug profile 31*c* and 31*d* formed in the bore of the adaptor 15. The figure also illustrates how the lower plug 31*b* is designed with necessary electrical, hydraulic, optical fiber or gas feed-through 19 to connect with the string or tubing below. Wet-mate connectors are mated to the signal, power and service lines between the plugs 31*a*, 31*b* to allow for horizontal access (similar to hybrid penetration at XT 4). Feed-through 19 can also be done vertically through the top of the hub 50. In that case, both plugs 31*a*, 31*b* will have vertical feed through capability. A high pressure debris cap 51 is installed on top of the adaptor 15. Between the XT hub 4 and the adaptor 15 is a XT connector 52 that interfaces the feed through to provide a conduit for the power and communication lines, or gas injection.

Figure 2:
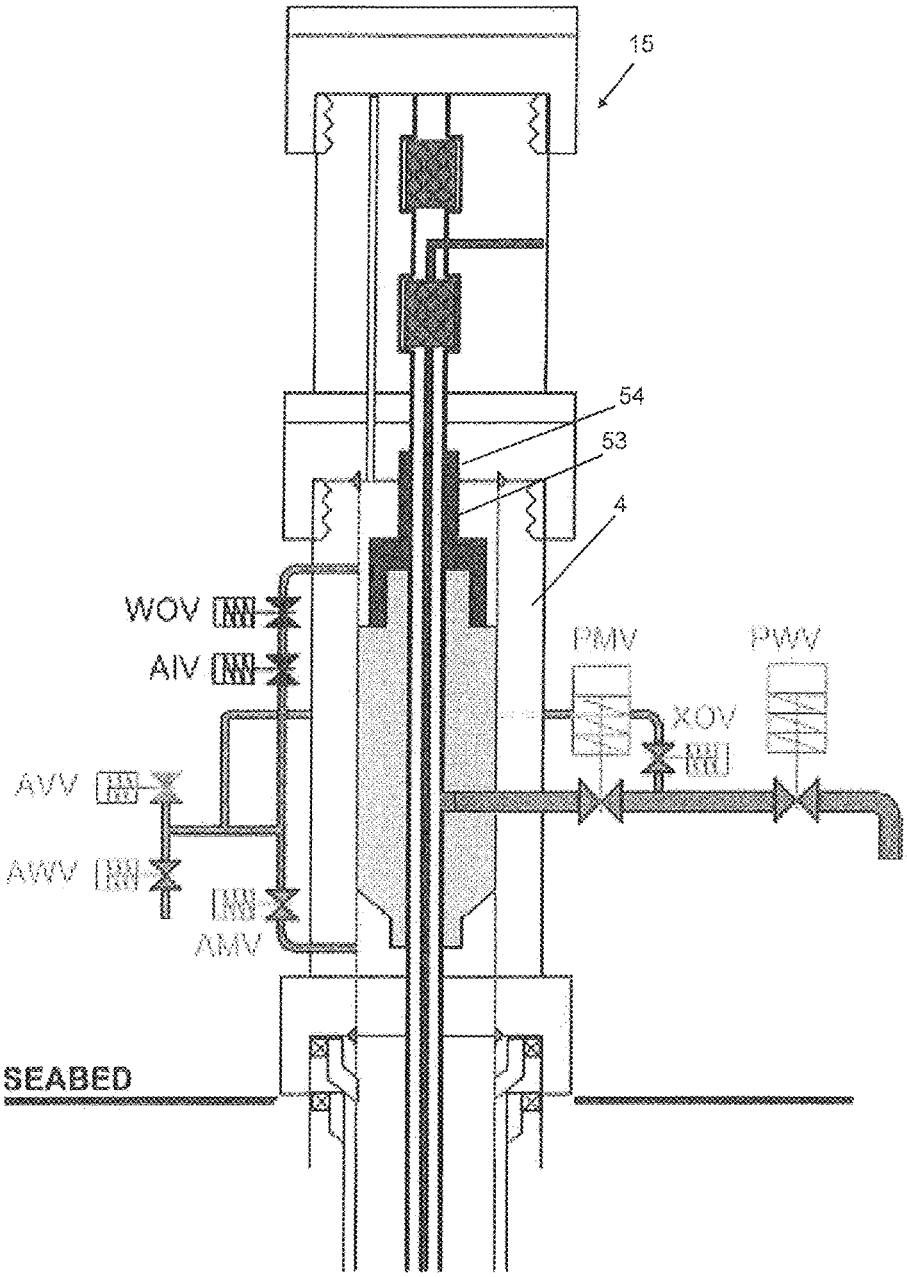
FIG. 2 illustrates an adaptor of the invention installed on a horizontal Xmas tree.
Figure 3:
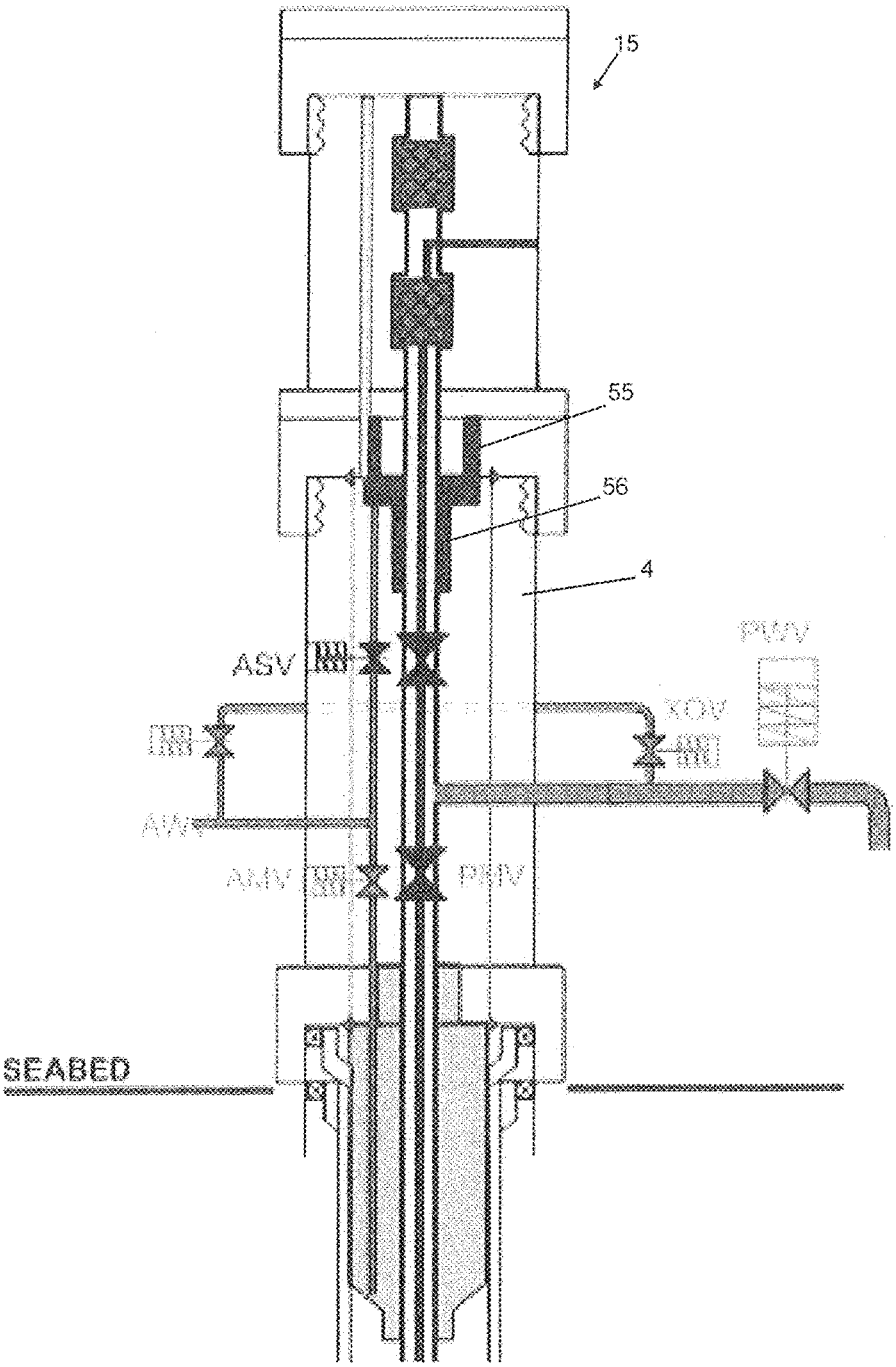
FIG. 3 illustrates an adaptor of the invention installed on a vertical Xmas tree.

FIGS. 2 and 3 below illustrate how the SUTHA adaptor 15 can be installed on both a horizontal (HXT) and vertical (VXT) x-mas trees 4. On the HXT 4 the SUTHA adaptor 15 has an inner profile 54 that interfaces with the Tubing Hanger 53 while on the VXT 4 the inner profile 55 interfaces with the inside of the XT spool 56.

FIGS. 4 and 5 illustrate horizontal and vertical feed-throughs 19, respectively, in adaptors 15 of the invention. As seen in FIG. 5, the vertical feed-through 19 is brought through a high pressure debris cap 51 on top of the adaptor 15. Inside the adaptor 15, the feed-through 19 is typically connected to a hanger connector 31, which is connected with power and communication to instrumentation and equipment in the well.

FIG. 6 illustrates an adaptor 15 of the invention installed on a hybrid Xmas tree.

FIG. 7 shows the principles of the known internal cabling method. The figure shows a well casing 1 that extends into the ground from a wellhead 2 arranged at the seabed 3. On top of the wellhead 2 is a Christmas tree 4. A production tubing 5 extends from the Christmas tree into the well on the inside of the casing. A pump unit 6 (sometimes called ESP) is situated within the production tubing. The Pump unit 6 is suspended from a coiled tubing 7. A signal and power cable 8 is situated within the coiled tubing 7. The coiled tubing is suspended from a hanger plug 9, which has been landed inside the Christmas tree 4. The cable 8 extends through a tree cap 10, and then up to the sea surface (not shown). The tree 4 is a horizontal Christmas tree. It is theoretically feasible, but highly unpractical to use this technique on a vertical Christmas tree due to the smaller production bore size of the vertical Christmas trees.

The major disadvantage of this method of suspending the pump unit 6 is the challenge met during installation of the system and the difficulties in replacing the ESP when it fails. In addition, it requires the use of coiled tubing for installation because of its greater tensile capacity compared to wireline. The weight of the complete system (mainly due to the heavy coiled tubing) also gives limitations to the installation depth. The installation is very difficult to perform on live wells, as the system is dependent on the closing of downhole valves to close the well below the location of the ESP. This makes the system less robust, and the options for contingency operations are limited. The replacement of the pump unit 6 is complex and costly. The reliability of downhole valves for closing the well below the pump unit is questionable, and if the downhole valve should fail, contingency is lost and an expensive operation is necessary to replace the valve.

External Cabling:

FIG. 8 shows a second alternative in established prior art. The well casing 1, wellhead 2, Christmas tree 4 and production tubing 5 are the same as in FIG. 1. In the external cabling method, the pump unit has been landed on a docking station 11. The docking station has been installed together with the production tubing and includes a penetration through the production tubing with a wet mate connection 12 for connecting the power and signal cable 8 to the ESP.

The cable 8 is routed on the outside of the production tubing 5, i.e. in the annulus between the production tubing 5 and the casing 1. It extends through a penetration 13 in the wellhead 2 and through a penetration 14 in the Christmas tree 4. Systems of this type are described in US20100707843 and US20100835578.

The penetration through the production tubing requires that the external cabling option infrastructure must be installed with the production tubing. As the completion must be specially made for the purpose, it requires changing the completion (inter alia the production tubing) if it is to be retrofitted on existing wells. This makes this method very costly to install in brownfield wells. The Christmas tree must also be replaced, as most trees do not have the required feed-through for a power and signal cable. If the docking station or cable is damaged and ceases to function, the whole completion must also be changed.

FIG. 9 shows several of the same elements as in FIGS. 1 and 2. The same reference numbers have been retained for elements that are substantially similar, such as the casing 1, the wellhead 2, the seabed 3, the Christmas tree 4, the production tubing 5, the pump unit 6 and the power and signal cable 8.

The pump unit is landed in a docking station 11', which is similar to the docking station 11 of FIG. 2, but does not include a penetration of the production tubing 5. The docking station 11' may nevertheless be installed together with the production tubing. Alternatively, it may be installed at a later stage by securing it to the inside surface of the production tubing, as will be generally known to the person of skill.

The docking station includes a wet mate connector (see FIG. 5) and the cable 8 is connected to the docking station 11', via a weak link 30, at the inside of the production tubing 5. The cable 8 extends along the production tubing 5 on the inside of the production tubing 5 from the docking station 11' through the wellhead 2 and through the Christmas tree 4.

At the top of the Christmas tree is connected an adapter 15. This adapter is shown in further detail in FIG. 4. The adapter 15 has a lower first interface 16, which is adapted to mate with a corresponding interface 17 on the top of the Christmas tree 4. At the top of the adapter 15 is an upper second interface 18, which is identical to the interface 17 on top of the Christmas tree 4.

The adapter 15 has a feed-through 19 for the power and signal cable 8, which goes through the adapter and onwards to the surface or alternatively connects with a wet mate connector on the outside of the adapter 15. The feed through of the cable 8 is in the lower part of the adapter 15 in order to reduce the height of the adapter 15 as much as possible.

In addition, the adapter 15 has internal plug profiles 20 and 21. Thereby the adapter 15 serves two purposes: 1. to provide a feed-through for the cable 8 and 2. to provide the Christmas tree with plug profiles. The plug profiles, which can be for one, two or more plugs, to plug the bore of the tree and thereby shutting in the well. Thereby, the adapter can serve to provide a tree 4 with additional plug profiles or replace a damaged plug profile within the tree. If one plug profile is provided, the adapter must be for high pressure to maintain two barriers, otherwise a debris cap on the top of the adapter is sufficient. The upper interface 18 of the adapter 15 is preferably of a standard profile, such as a H4 hub, to allow a workover riser system to be connected on top of the adapter 15.

The adapter 15 can also be used for other applications, such as when extra power and/or signals are needed in the well, and when it is considered beneficial to install the equipment inside the production tubing to avoid having to change the completion. Such functions could be smart well functionality, such as closing and opening parts of the reservoir to produce more oil/gas and less water, extra valves for well control, monitoring systems, etc.

FIG. 10 shows the docking station 11' in more detailed. It comprises a docking sleeve 22 and a set of seal elements 23, 24, which serves to lock the sleeve 22 against the inner surface of the production tubing 5, and to seal the annulus between the sleeve 22 and the production tubing 5. The sleeve 22 comprises an ESP landing shoulder 25, which is adapted to receive the pump unit 6. It also comprises plug profiles 26, 27 that are adapted to receive a plug (not shown). The possibility of landing a plug in the docking station 11' will be described further below.

The docking station also comprises a wet mate connector 28, which is in this embodiment is connected to a short cable length 29 and a weak link 30. The weak link is in turn connected to the power and signal cable 8. Alternatively, the weak link 30 may be on the docking station 11', as shown in FIG. 3.

An important feature of the docking station 11' design is that it does not rely on features within the completion tubing for it to be secured within the production tubing. Therefore, the docking station can be secured and sealed to the production tubing by, for example, packers. The seal can either be permanent or be releasable by control signals through the cable 8, or through other mechanical or chemical means, as known per se. The pump unit will be landed on the landing shoulder 25 and connected to the cable 8 through the wet mate connector 28.

FIG. 11 shows a situation in which a docking station 11' has been rendered dysfunctional. This may be because the wet mate connector 28 is faulty, because of damage to the ESP landing shoulder, or other flaws that result in the docking of the pump unit and connection thereof to the cable 8 no longer can be performed. In such a situation, the pump unit (not shown in FIG. 6) will be recovered and a plug (not shown) may be landed and secured to the plug profiles 26, 27 in the docking station 11' so that the flow through the docking station is blocked. The plug may be of a type that dissolves through prolonged contact with the well flow or due to an excess pressure on one side of the plug, e.g. plugs made of glass. Such plugs are well known in the art.

Before or after the plug has been set in the docking station, a pull is exerted on the cable 8 (see FIG. 5). The pull breaks the weak link 30, so that only the short cable length 29 remains. Then the cable 8 may be pulled out of the well for re-use or replacement.

When the flow through the docking station has been blocked, a new docking station 11" may be run into the production tubing 5 and secured to the inner surface of the production tubing 5. This docking station 11" may be identical to the faulty docking station 11', but may also be of an improved type. The cable that was recovered from the well, or alternatively a new cable, is connected to the new docking station 11" prior to its insertion into the well. The pump unit that was recovered from the first docking station 11' may be (if it has not been damaged) landed on the new docking station 11" and coupled to the cable 8 through the wet mate connector 28'. Thereafter the plug that has been set in the first docking station 11' will be removed by well-known means. As soon as the plug has been removed, the operation of the ESP may resume.

As described above, if a new docking station is to be installed, the old one can be left in the well. The cable 8 can then be released and reused (if not damaged) by performing the described over-pull on the cable 8 to break the weak link 30. Since the old docking station has plug profiles 26, 27 to enable easy plugging of the well at the correct location, this allows for retrieving of the cable 8 on a closed well.

The power and signal cable 8 (also termed ESP cable) may comprise power lines, signal lines and hydraulic lines. According to the invention, the cable 8 can be routed from the adapter 15 or tree cap in several different ways. However, it should be ensured that the cable runs close to the inner wall of the production tubing. This provides better space for running the pump unit into and out of the well, as well as other types of equipment. The cable 8 will also be less subject to forces from the well flow.

FIG. 13 describes an embodiment of the present invention, which utilizes the adapter 15 described above in combination with a pump unit 6 suspended on a length of coiled tubing 7 from a hanger plug 31. This embodiment can be beneficial for cases where it is difficult to get the correct hanger plug profile to fit the existing profiles in the Christmas tree 4. The adapter 15 will provide the desired internal profile for a plug 9', from which the coiled tubing is suspended. The cable 8 may be going out through a tree cap 10' on top of the adapter 15 or be fed through the side of the adapter 15, as described in connection with the embodiment in FIGS. 3 and 4. The embodiment of FIG. 7 may also be beneficial over prior art for contingency operations, since an open water workover system can land on the standard, e.g., H4, hub profile and gain well control before the hanger plug is removed.

A possible first time installation of the arrangement of the present invention may be as follows:

1. Plug the well using glass, step, or dissolvable plugs.
2. Circulate the well above the plugs with MEG (or similar types of fluids) using, e.g., coiled tubing.
3. Land the adapter on the Christmas tree, with the cable and the docking station attached.
4. Secure the docking station to the production tubing using, e.g., packers or other means that acts against a slick tubing surface.
5. Land a workover system (open water or riserless system) on top of the adapter.
6. Install the pump unit by landing it in the docking station.
7. Plug the adapter and install a debris cap, or a high-pressure tree cap.
8. Break the plugs, e.g., glass plugs, by pressurising through the Christmas tree. Alternatively, let the plugs dissolve by contact with the well flow, or use explosives to dissolve the plugs.

When the pump unit needs to be replaced, the following procedure can be used:

1. Install a workover system on top of the adapter (either an open water or a riserless system).
2. Remove the plugs in the adapter.
3. Remove the pump unit using a wireline (preferably, the pump can be retrieved in several parts to enable conventional wireline to be used and to reduce the required lubricator length).
4. Install a new pump unit (preferably in several parts).
5. Set plugs in the adapter and install a debris cap or a high-pressure cap.

If the docking station, cable or adapter should fail, the following procedure can be used:

1. Install workover system on top of the adapter (either open water or riserless system)
2. Remove plugs in the adapter
3. Remove the pump unit using wireline (preferably, the pump can be retrieved in several parts to enable conventional wireline to be used and to reduce the required lubricator length).
4. Set glass or dissolvable plugs in the docking station to close the well.
5. Circulate the well by, e.g., MEG.
6. Retrieve the adapter with a running tool, performing over-pull to release the cable at the weak link close to the docking station.
7. Perform the same operation as described for first time installation.

The adaptor of the invention may include any feature or step herein described or illustrated, in any operative combination, each such combination is an embodiment of the invention.

The method of the invention may include any feature or step herein described or illustrated, in any operative combination, each such combination is an embodiment of the invention.

The invention claimed is:

1. An adapter for an oil or gas field Christmas tree, said adapter comprising:

a first interface to connect the adapter to a corresponding Christmas tree interface on a top of the Christmas tree;

a second interface;

at least one feed-through configured to convey electric power;

at least one of: a well barrier element, an internal profile for setting a plug, or a combined hanger and plug;

wherein said second interface is identical to the Christmas tree interface, and said second interface is at an end of the adapter opposite of said first interface; and wherein the adapter comprises a string hanging down from a lower well barrier within the adapter, through the Christmas tree, and into a production tubing.

2. The adapter according to claim 1, wherein the at least one feed through, arranged lateral or axial, connects an inside of the adapter to an outside of the adapter, and the well barrier element is a well barrier compliant valve or plug, or a combination thereof.

3. The adapter according to claim 1, wherein the feed-through is configured to convey at least one of: electric communication, optical communication, hydraulic liquid, and gas, in any combination.

4. The adapter according to claim 1, wherein said string encloses lines, cables and tubes, said string being suspended from the lower well barrier within the adapter, wherein the lower well barrier is the well barrier element, the combined hanger and plug or the plug within said Christmas tree or said adapter.

5. The adapter according to claim 1, wherein said feed-through extends laterally through a sidewall of said adapter.

6. The adapter according to claim 1, wherein said feed-through extends vertically through a cap on top of said adapter.

7. The adapter according to claim 1, wherein said feed-through is arranged below said well barrier element.

8. The adapter according to claim 1, wherein the adapter comprises two well barriers and said feed-through is arranged between said two well barriers.

9. The adapter according to claim 1, wherein the first interface comprises a Christmas tree connector either adapted to interface with a tubing hanger of the Christmas tree, for connecting to horizontal Christmas trees, or with an inside of a Christmas tree spool, for connecting to vertical Christmas trees.

10. The adapter according to claim 1, wherein the adapter is a high-pressure unit capable of withstanding well pressure.

11. The adapter according to claim 1, wherein the second interface is an H4 profile.

12. An oil or gas field Christmas tree having an adapter, the adapter comprising:

a first interface connected to a Christmas tree interface on a top of the Christmas tree and a second interface identical to the Christmas tree interface arranged at an end of the adapter opposite of said first interface;

the adapter further comprising at least one feed-through configured to convey electric power to a pump unit via a cable;

the pump unit being suspended into a production tubing from a hanger within the adapter via a string, wherein the string comprises the cable and extends from the hanger, through the Christmas tree, and into the production tubing; and the adapter comprising a plug arranged in a through-channel of the adapter, the plug arranged to form a pressure barrier in the through-channel.

13. The oil or gas field Christmas tree adapter according to claim 12, wherein the hanger and the plug are a combined hanger and plug arranged in the through-channel.

14. The oil or gas field Christmas tree adapter according to claim 12, wherein the plug is a first plug forming a first pressure barrier, and the adapter comprises a second plug arranged in the through-channel, the second plug arranged to form a second pressure barrier in the through-channel.

15. The oil or gas field Christmas tree adapter according to claim 14, wherein the hanger and the second plug are a combined hanger and plug arranged in the through-channel.

16. The oil or gas field Christmas tree adapter according to claim 12, wherein the hanger is arranged in the through-channel.

17. The oil or gas field Christmas tree adapter according to claim 12, wherein said feed-through extends laterally through a side wall of said adapter.

18. The oil or gas field Christmas tree adapter according to claim 12, wherein said feed-through extends vertically through a cap on top of said adapter.

19. The oil or gas field Christmas tree adapter according to claim 12, wherein:

the first interface comprises a Christmas tree connector;

the Christmas tree is a horizontal Christmas tree and the connector interfaces with a tubing hanger of the Christmas tree.

20. The oil or gas field Christmas tree adapter according to claim 12, wherein:

the first interface comprises a Christmas tree connector;

the Christmas tree is a vertical Christmas tree and the connector interfaces with an inside of a spool of the Christmas tree.

* * * * *